United States Patent [19]

Pereda

[11] 3,987,632

[45] Oct. 26, 1976

[54] LIQUID AIR ENGINE

[76] Inventor: Eugene F. Pereda, 11621 Hughes Ave., NE., Albuquerque, N. Mex. 87112

[22] Filed: July 30, 1971

[21] Appl. No.: 167,671

Related U.S. Application Data

[63] Continuation-in-part of Ser. No. 18,404, Feb. 27, 1970, abandoned.

[52] U.S. Cl. ..... 60/671

[51] Int. Cl.[2] ..... F01K 25/10

[58] Field of Search ..... 219/271, 272, 275; 62/45, 345; 165/83, 84; 244/134 A; 60/651, 671

[56] References Cited

UNITED STATES PATENTS

| | | | |
|---|---|---|---|
| 671,608 | 4/1901 | Ostergren | 60/36 |
| 1,310,253 | 7/1919 | Shuman | 60/36 |
| 2,289,204 | 7/1942 | Milton | 219/271 X |
| 2,327,034 | 8/1943 | Geer | 244/134 A |
| 2,567,804 | 9/1951 | Davies | 244/134 A |
| 2,683,359 | 7/1954 | Green, Jr. | 62/72 |
| 2,793,988 | 5/1957 | Lathan, Jr. et al. | 165/84 X |
| 3,028,470 | 4/1962 | Spracklen | 219/271 X |
| 3,209,125 | 9/1965 | Morrissey | 219/273 X |
| 3,398,261 | 8/1968 | Mays | 219/272 |

FOREIGN PATENTS OR APPLICATIONS

| | | | |
|---|---|---|---|
| 27,153 | 12/1898 | United Kingdom | 60/36 |

*Primary Examiner*—Allen M. Ostrager
*Attorney, Agent, or Firm*—Clarence A. O'Brien; Harvey B. Jacobson

[57] ABSTRACT

Liquid air injected into a chamber at a controlled rate undergoes a change in state to supply expanding gas to a turbine. The chamber is controllably heated to regulate conversion of the liquid air into gas and extraction of energy therefrom by the turbine isentropically.

3 Claims, 2 Drawing Figures

FIG. 1

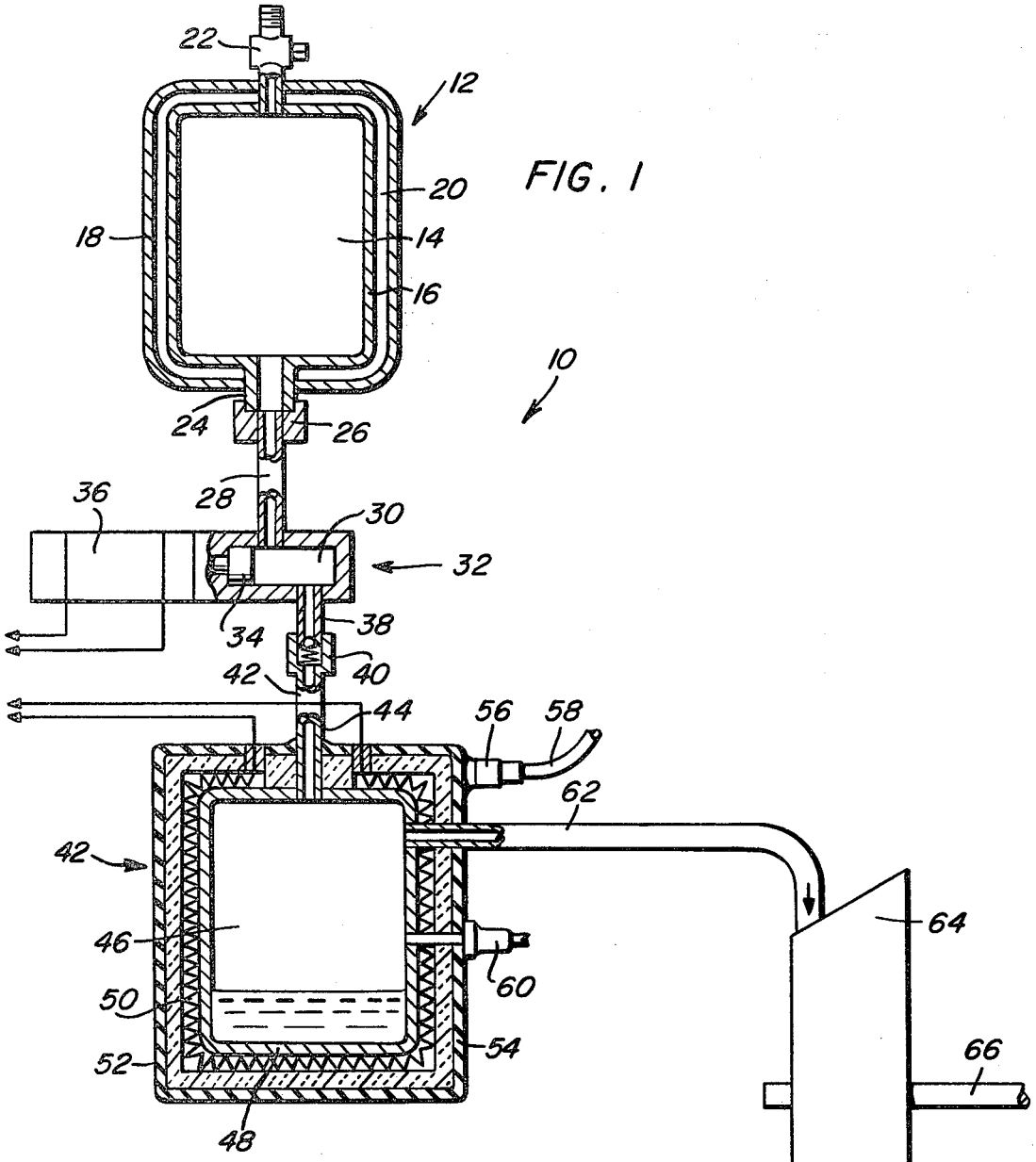
FIG. 1
FIG. 2
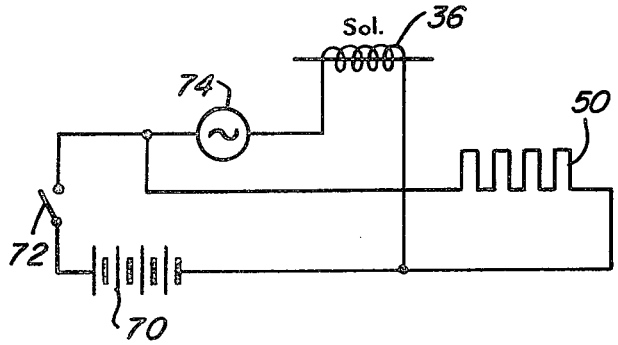

LIQUID AIR ENGINE

This application is a continuation-in-part of my prior copending application U.S. Ser. No. 18,404, filed Feb. 27, 1970, now abandoned.

This invention relates to a non-polluting power plant of the type wherein energy is extracted from a fluid as it undergoes a change in state from liquid to gaseous form.

Except for hydroelectric types of power plants, the generation of mechanical energy usually involves combustion of fuel or extraction of energy from expanding gases exhausted into the atmosphere which contribute to air pollution. It is therefore an important object of the present invention to provide a power plant of the type in which no polluting fuel combustion is involved nor exhaust of polluting products into the atmosphere.

In accordance with the present invention, mechanical energy is obtained by conversion of internal energy of an expanding gaseous fluid into mechanical energy with a controlled minimal addition of heat. The air in gaseous form is supplied to the turbine from a control chamber within which the air undergoes a change in state from liquid to gas. Liquid air in an insulated storage tank is injected at a controlled rate into the control chamber at a regulated pressure. The temperature of the fluid within the control chamber is regulated by a heating element in order to control the thermodynamic process under which the liquid is converted into gas before being fed to a fluid motor such as a gas turbine.

These together with other objects and advantages which will become subsequently apparent reside in the details of construction and operation as more fully hereinafter described and claimed, reference being had to the accompanying drawings forming a part hereof, wherein like numerals refer to like parts throughout.

FIG. 1 is a somewhat schematic and partial sectional view of a power plant constructed in accordance with the present invention.

FIG. 2 is a simplified electrical circuit diagram illustrating the basic control system associated with the power plant shown in FIG. 1.

Referring now to the drawings in detail, and initially to FIG. 1, a power plant generally denoted by reference numeral 10 is shown which includes an insulated tank 12 within which a supply of liquid air 14 is stored. Inasmuch as the air exists as a liquid under a relatively low temperature, the storage tank 12 must be effectively insulated to prevent absorption of heat from the atmosphere. Thus, the storage tank includes an inner container 16 made of a thermally non-conductive material such as glass spaced from a reflective outer casing 18 by an insulating space 20. A relief valve 22 is connected to the inner container 16 in order to prevent development of excessive pressure within the storage tank. An outlet 24 is connected by a fitting 26 to a conduit 28 through which the liquid air is conducted to a pressure charging chamber 30 of an injection mechanism 32.

The injection mechanism 32 includes a piston 34 adapted to be reciprocated under control of a solenoid 36 in order to displace liquid air supplied by conduit 28 to the pressure charging chamber 30, into the outlet conduit 38 connected by a one-way check valve 40 to a control chamber device generally referred to by reference numeral 42.

The liquid air under pressure is fed from the injecting mechanism 32 through the check valve 40 and the inlet conduit 43 into the control chamber 46 enclosed by an inner steel tank 48. An electrical heating element 50 is mounted in heat conductive relation to the tank 48 for controllable heating of the contents thereof. An outer cover 52 made of a flexible material such as rubber encloses the heating element 50 and tank 48 and is internally lined by an insulating material such as asbestos 54. The outer cover is inflatable by being connected to a source of pressurized inflation fluid by means of the fitting 56 and conduit 58. In this manner, the control chamber device 42 may be operative to break up any external ice formations on the surface of the chamber device 42 resulting from the extreme cold temperatures involved in utilizing liquid air. A pressure relief valve 60 is connected to the inner steel tank 48 in order to limit the maximum pressure developed within the chamber device.

The liquid air within the chamber 46 is converted into gaseous form and is conducted through the outlet conduit 62 to the inlet of a gaseous air turbine 64. The turbine 64 is of the type having relatively large diameter blades and a small axial dimension in order to extract pressure volume energy from the air isentropically (a thermodynamic process in which there is no change in entropy and heat). The outlet shaft 66 of the turbine is drivingly connected by suitable gearing to any desired load. Finally, the exhaust from the turbine 64 is conducted to atmosphere by the exhaust conduit 68. It will be apparent that in the case of the present invention, the exhaust of the turbine will be air so that there will be no atmospheric pollution involved.

In accordance with the present invention, energy is extracted from the fluid during the vapor phase cycle as the fluid undergoes a substantially isothermal process while changing state. Useful work is obtained from the fluid as a result of its pressure-volume relationship. A relatively small amount of heat is therefore required to achieve the foregoing and such heat is supplied to the chamber device by the heating element 50 aforementioned. The amount of heat supplied for this purpose is furthermore correlated with the inflow rate of the liquid air into the chamber 46 in order to meet a predetermined load on the turbine 64.

As shown in FIG. 2, the heating element 50 is energized by being connected across the output terminals of an electrical source of energy such as battery 70, upon closing of the switch 72. Also connected across the output terminals of the battery is the solenoid 36 in series with a pulsator 74 by means of which the reciprocatory cycle of the piston 34 is controlled in the injecting mechanism 32. As a result of the foregoing arrangement, the power plant operates in the temperature-entropy plane in such a manner as to require a minimal amount of electrical energy to change the state of the liquid air to gas in order to produce useful mechanical power.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a power plant having a turbine, insulated storage means containing a supply of liquid air, thermal controlling chamber means connected to the turbine for supply of expanding air in gaseous form to the turbine while the air is undergoing an isothermal change in state, means connected to the storage means for intermittently injecting the liquid air into the chamber means, and heating means in heat transfer relation to the chamber means for thermally regulating said isothermal change in state of the air between liquid and gaseous form without heating the air supplied to the turbine, said injecting means including pressure charging means connected to the storage means for receiving liquid air therefrom, a piston movably mounted in the pressure charging means for displacement of the liquid air therefrom, and one-way valve means connecting the pressure charging means to the chamber means.

2. The combination of claim 1 including a source of electrical energy connected to the heating means, solenoid means connected to the piston for reciprocation thereof and pulsating means connecting the source to the solenoid means for operation of the injecting means simultaneously with energization of the heating means.

3. In a power plant having a turbine, insulated storage means containing a supply of liquid air, thermal controlling chamber means connected to the turbine for supply of expanding air in gaseous form to the turbine while the air is undergoing an isothermal change in state, means connected to the storage means for intermittently injecting the liquid air into the chamber means, heating means in heat transfer relation to the chamber means for thermally regulating said isothermal change in state of the air between liquid and gaseous form without heating the air supplied to the turbine, a source of electrical energy connected to the heating means, solenoid means connected to the injecting means and pulsating means connecting the source to the solenoid means for operation of the injecting means simultaneously with energization of the heating means.

* * * * *